US012550955B2

(12) United States Patent
Lesosky

(10) Patent No.: US 12,550,955 B2
(45) Date of Patent: Feb. 17, 2026

(54) KNEEPADS

(71) Applicant: TOMMYCO KNEEPADS, INC., Delta (CA)

(72) Inventor: Thomas Jeffrey Lesosky, Surrey (CA)

(73) Assignee: Tommyco Kneepads, Inc., Delta (CA)

( * ) Notice: Subject to any disclaimer, the term of this patent is extended or adjusted under 35 U.S.C. 154(b) by 0 days.

(21) Appl. No.: 18/934,849

(22) Filed: Nov. 1, 2024

(65) Prior Publication Data

US 2025/0143390 A1 May 8, 2025

Related U.S. Application Data

(60) Provisional application No. 63/547,237, filed on Nov. 3, 2023.

(51) Int. Cl.
*A41D 13/06* (2006.01)
*A41D 13/05* (2006.01)

(52) U.S. Cl.
CPC ..... *A41D 13/065* (2013.01); *A41D 13/055* (2013.01)

(58) Field of Classification Search
CPC ..... A41D 13/055; A41D 13/065
USPC ..... 2/24
See application file for complete search history.

(56) References Cited

U.S. PATENT DOCUMENTS 5,537,589 A * 7/1996 Dalal ..... G06Q 30/06
5,611,080 A * 3/1997 Skottheim ..... A41D 13/0568 2/22
6,253,376 B1 * 7/2001 Ritter ..... A41D 13/065 2/24
6,820,279 B2 11/2004 Lesosky
7,096,508 B2 8/2006 Lesosky
8,181,271 B2 * 5/2012 Sasaki ..... A41D 13/0568 2/24
9,015,862 B2 4/2015 Wood
2009/0126066 A1 5/2009 Sasaki et al.
2015/0264987 A1 * 9/2015 Morin ..... A41D 13/08 2/455
2018/0213857 A1 8/2018 Miller
2023/0120562 A1 4/2023 Schaaper
2025/0091133 A1 * 3/2025 Shingai ..... B22F 10/14
2025/0143390 A1 * 5/2025 Lesosky ..... A41D 13/055

OTHER PUBLICATIONS

International Search Report and Written Opinion dated Jan. 2, 2025 in connection with International Patent Application No. PCT/CA2014/051450, 11 pages.

* cited by examiner

*Primary Examiner* — Gloria M Hale
(74) *Attorney, Agent, or Firm* — Dorsey & Whitney LLP

(57) ABSTRACT

A kneepad device includes an outer cover having a curved body and including two or more protrusions positioned along, and extending away from, an inner surface of the curved body. The kneepad also includes an inner cushion configured to couple with the outer cover and contact a knee of a user when being worn. The outer cover has a hardness that is greater than that of the cushion, such that the outer cover provides a protective shell, and the inner cushion conforms to the surface of the user's knee. When coupled, the outer cover and inner cushion define an air pocket therebetween, which reduces the localized pressure exerted on the user's knee when kneeling. The two or more protrusions can define elongate strips of material, the space between which further defines the air pocket between the cover and the cushion.

29 Claims, 9 Drawing Sheets

KNEEPADS

CROSS-REFERENCE TO RELATED APPLICATIONS

This application claims priority to U.S. Provisional Patent Application No. 63/547,237, filed Nov. 3, 2023, entitled "KNEEPADS," which is incorporated by reference herein, in the entirety and for all purposes.

TECHNICAL FIELD

Implementations relate to kneepads, including kneepad assemblies and components thereof. Particular implementations include a kneepad cover and corresponding cushion that define a pressure-reducing air pocket therebetween.

BACKGROUND

Kneepads are used to protect a user's knees when kneeling on hard surfaces, or when extensive kneeling is required on any surface. Prolonged or frequent kneeling exerts pressure on the knee, especially the patella, that may cause discomfort or injury. The blunt force of contacting the knee with a hard surface, such as concrete, may also cause or exacerbate injury.

Various kneepad designs have been developed to address these problems, including kneepads having elaborate, mesh-like structures configured to absorb pressure by flexing or compressing. Such designs may be constrained by the configuration of the overall kneepad design, including rigid components designed specifically to accommodate particular pressure-absorbing features.

New kneepads are needed to effectively protect the knees of a user.

SUMMARY

Embodiments of the present disclosure provide a kneepad comprising an outer cover having a curved body and including two or more protrusions positioned along an inner surface of the curved body. The kneepad may also include an inner cushion configured to couple with the outer cover and contact a knee of a user when worn by the user. The outer cover may have a hardness that is greater than that of the cushion. When coupled, the outer cover and inner cushion may define an air pocket therebetween.

In some examples, the protrusions may extend away from the inner surface of the curved body of the cover, toward the inner cushion. In some examples, the protrusions may include two or more raised strips of material. In some examples, the raised strips of material may have a material composition distinct from that of the curved body. In some examples, the raised strips of material may comprise one or more foam compositions, which may be rigid or semi-rigid. In some examples, the protrusions may be defined by the curved body. The outer cover may be a unitary mold in some examples.

In some examples, the air pocket may reduce a pressure exerted on a knee when a user kneels while wearing the kneepad. In some examples, the air pocket may be further defined between the two or more protrusions. In some examples, a portion of the inner cushion may sag into the air pocket when the kneepad is worn by the user, especially when the user is kneeling. In some examples, the two or more protrusions may comprise two elongate curved protrusions configured to curve around a patella of the knee, such that when the kneepad is worn, a portion of the cushion positioned over the patella may sag into the air pocket defined between the two protrusions. In some examples, the distance between the elongate curved protrusions may vary along the length of the protrusions. In some examples, each of the one or more protrusions may have a length of about 8 cm to about 12 cm, and a width of about 15 mm to about 30 mm. In some examples, the curved body may further include at least one raised portion protruding from an outer surface of the curved body. The raised portion may be configured to be positioned over at least a portion of a shin of the user when the kneepad is worn.

In some examples, the kneepad may also include an upper extension configured to be positioned at least partially above a patella and over a thigh of the user when the kneepad is worn. In some examples, the upper extension may have a textured outer surface. In some examples, the textured surface may include a plurality of grooves and ridges. In some examples, the upper extension may be configured to move or pivot relative to the curved body. In some examples, the upper extension may have a body portion and an outer surface layer. The outer surface layer may have a hardness that is greater than that of the body portion. In some examples, the outer surface layer may include a plate.

Embodiments of the present disclosure provide a kneepad cover having a curved body and two or more protrusions positioned along an inner surface of the curved body. The curved body of the kneepad cover may comprise a rigid or semi-rigid polymer composition configured to resist damage when engaging hard surfaces. The curved body may correspond to or mirror the curvature of a knee of a user.

In some examples, the two or more protrusions may comprise two raised strips of material that protrude away from the inner surface of the curved body, such that upon placing the kneepad cover over the knee of a user, the two or more strips protrude toward the knee. In some examples, the distance between the two raised strips of material may vary along a length of the strips, ranging from about 40 mm to about 70 mm. In some examples, the two raised strips may be curved. In some examples, the material of the two or more protrusions may be identical to that of the curved body. In some examples, the kneepad cover may be a unitary mold. In some examples, the material of the two or more protrusions may be distinct from that of the curved body. In some examples, the two or more protrusions may be attached to the inner surface of the curved body. In some examples, the two or more protrusions may comprise detachable inserts.

These and other examples and objects of the present devices and related methods will be set forth in the following Detailed Description.

BRIEF DESCRIPTION OF THE DRAWINGS

The drawings illustrate generally, by way of example but not by way of limitation, various embodiments discussed in the present patent document. Like numerals can be used to describe similar features and components throughout the several views. In the drawings.

Figure 1A:
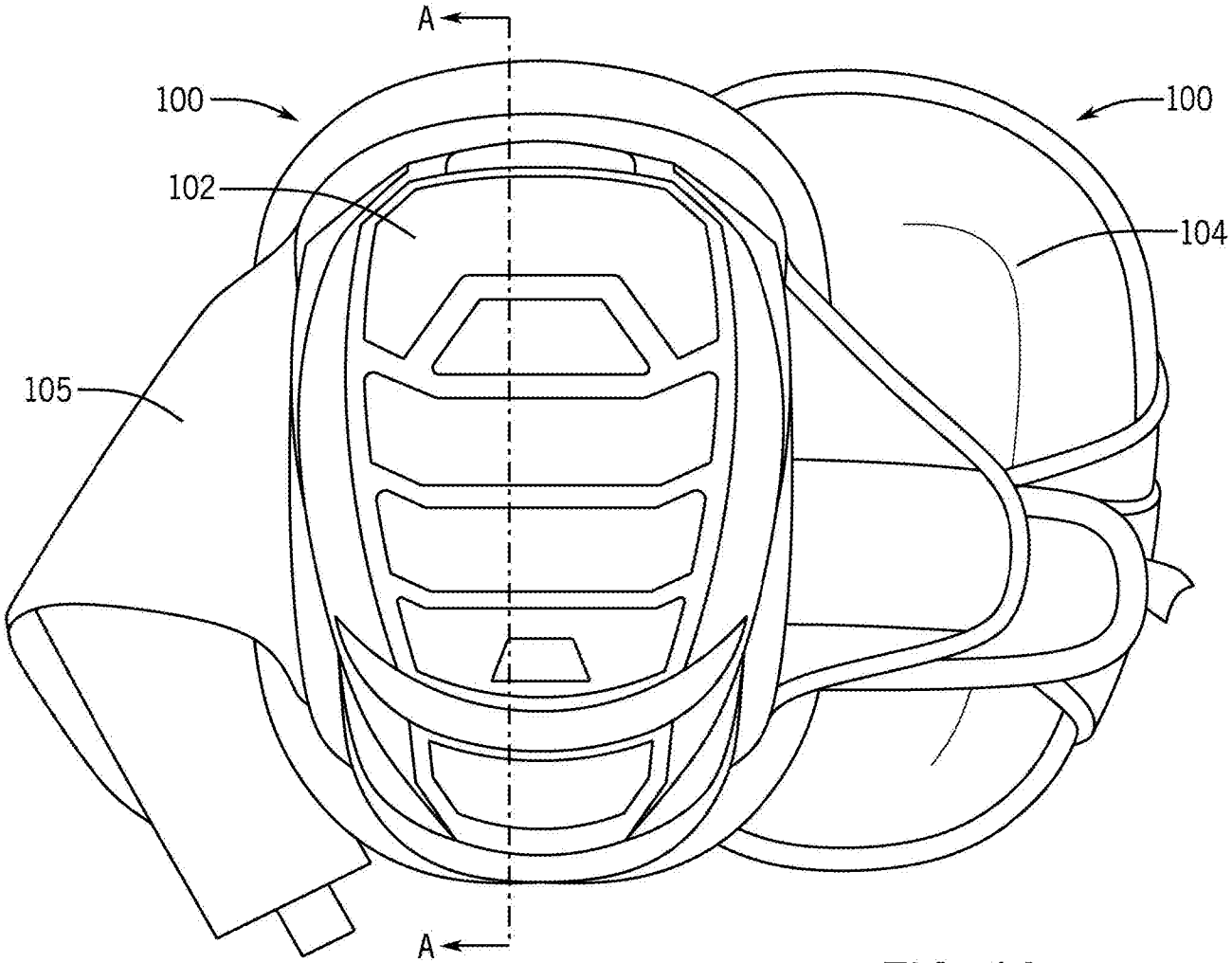
FIG. 1A illustrates a front view of one kneepad and a rear view of another kneepad in accordance with embodiments of the present disclosure.

The drawing figures are not necessarily to scale. Certain features and components may be shown exaggerated in scale or in schematic form and some details may not be shown in the interest of clarity and conciseness.

DETAILED DESCRIPTION

The following description of certain examples is in no way intended to limit the disclosure or its applications or uses. In the following Detailed Description of examples of the present devices, assemblies, apparatuses, and components thereof, reference is made to the accompanying drawings which form a part hereof, and in which are shown by way of illustration specific examples in which the described embodiments may be implemented. These examples are described in sufficient detail to enable those skilled in the art to practice the presently disclosed embodiments, and it is to be understood that other examples may be utilized and that structural or procedural changes may be made without departing from the spirit and scope of the present disclosure. Moreover, for the purpose of clarity, detailed descriptions of certain features will not be discussed when they would be apparent to those skilled in the art so as not to obscure the description of the present disclosure. The following detailed description is therefore not to be taken in a limiting sense, and the scope of the present systems and methods is defined only by the appended claims.

As used herein, the terms "anterior" and "front" may be interchangeable. Both terms may refer to a surface or portion of a disclosed kneepad component that faces away from the knee of a user when the kneepad is being worn. The terms "inner," "rear," "back," and/or "posterior" may also be used interchangeably herein, each term referring to a surface or portion of a disclosed kneepad component that faces toward the knee of a user when the kneepad is being worn.

FIG. 1A shows two of the disclosed kneepads facing opposite directions, such that the outer cover of one kneepad is visible, and the inner cushion of the other kneepad is visible. The two kneepads illustrated in FIG. 1A are identical and configured to be worn at the same time, one on each knee of a user. For ease of illustration, the kneepad features described below will reference the components of a single kneepad, designated as kneepad 100.

Each kneepad 100 may generally include an outer shell or cover 102 and an inner pad or cushion 104 that together protect a knee of a user when being worn. The cover 102 is configured to contact various surfaces, including the ground, while the inner surface of the cushion 104 is configured to contact and at least partially surround the surface of a user's knee, including the patella. The outer cover 102 has a greater hardness value than the inner cushion 104 such that in combination, the cover 102 and cushion 104 provide a durable structure that is hard enough to resist being damaged upon sustained contact with hard surfaces, and also soft enough to form around and comfortably reduce pressure on a user's knee when kneeling. One or more straps 105, e.g., Velcro straps, may be attached to each kneepad 100 for securing the kneepad around a user's knee.

The cover 102 and cushion 104 may be releasably coupled, such that the two components may be separated if desired. Alternatively, the cover 102 and cushion 104 may be permanently attached or fixed together. Embodiments featuring a cover 102 detachable from the inner cushion 104 may include one or more fasteners or attachment mechanisms manually engageable by a user. Non-limiting examples of attachment mechanisms may include one or more snaps, lip-and-groove components, buckles, Velcro surfaces, bindings, straps, clamps, magnets, sliding attachments, friction-fit mechanisms, locks, or combinations thereof. In embodiments featuring snaps, the snaps may be fixed or built into an outer portion of the cushion 104, for example near its peripheral edge, as well as an inner surface of the cover 102. The cover 102 may be detached from the cushion 104 without removing the entire kneepad assembly from the user's knee, allowing quick separation of the two components when desired.

Figure 1B:
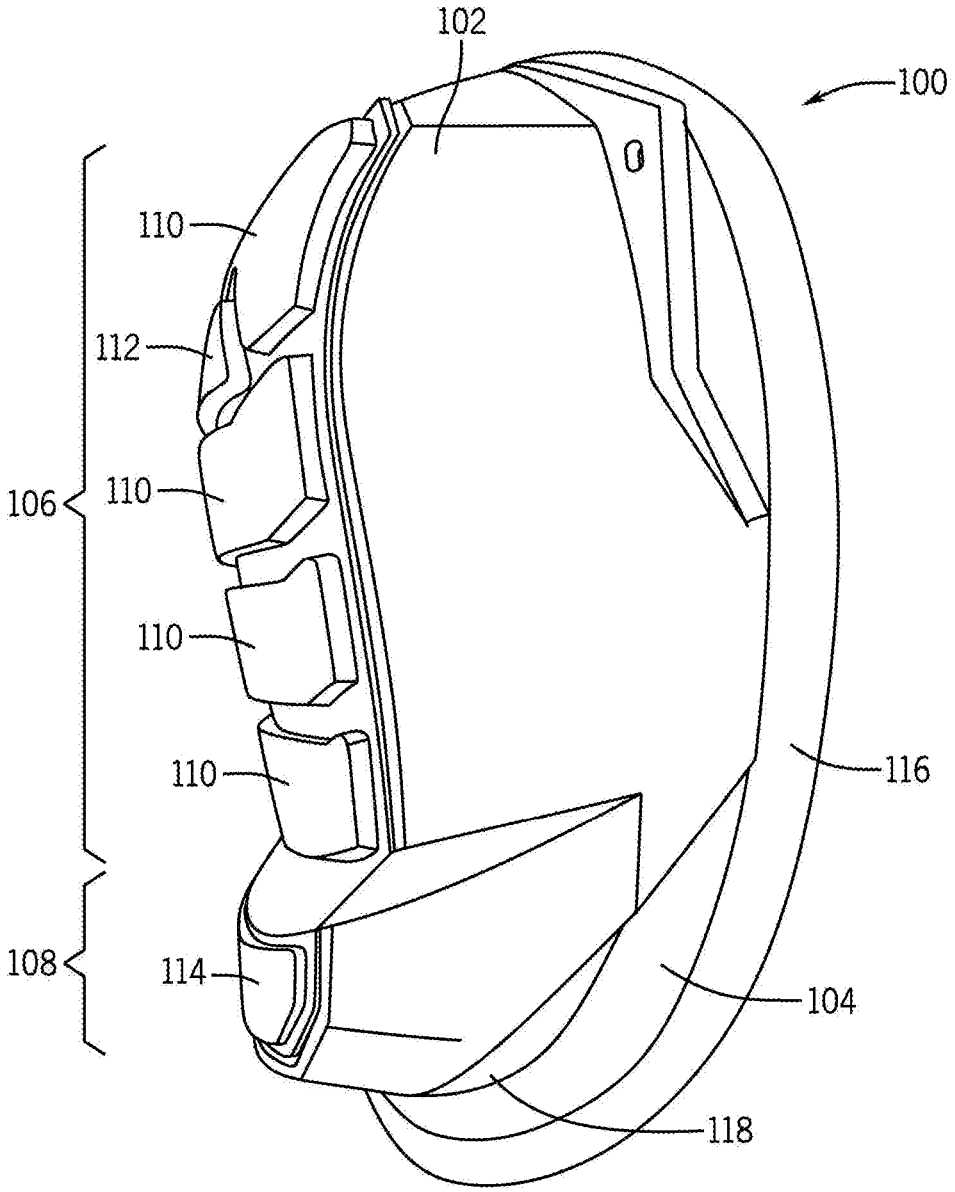
FIG. 1B illustrates a side view of one of the kneepads shown in FIG. 1A, showing the cover and cushion of the kneepad in accordance with embodiments of the present disclosure.

As further shown in FIG. 1B, which illustrates a side view of the kneepad 100, the outer surface of the cover 102 may include or define two or more sections, such as a knee section 106 and a shin section 108 that together provide a curved body configured to cover and protect a user's knee and upper shin, respectively. The curvature of the knee section 106 may approximately match or correspond to the curvature of a user's knee, including the patella, with the lateral portions of the cover 102 sloping away from the front surface of the cover 102. Embodiments may lack the shin portion 108, such that the curved body portion of the cover 102 includes the knee section 106, spanning from the front surface to the rear surface of the cover 102.

In the illustrated embodiment, the cover 102 includes a knee section 106 having a plurality of elevated ridges, raised portions, or rib-like projections 110 extending horizontally across the cover 102. Each of the projections 110 may protrude outwardly, away from the front surface of the cover 102, thereby providing additional protection to a user's knee when kneeling against hard surfaces. The projections 110 may also increase the traction between the cover 102 and a contact surface, e.g., the ground, which may reduce slippage of the cover 102 and thus the kneepad 100 as a whole. To further improve traction, the projections 110 may have a textured surface, such as a surface defining a grid-like pattern of grooves and ridges. Additional textured surfaces may feature a plurality of nodules, bumps, or ridges/grooves in a variety of arrangements. The material composition of the projections 110, which may include one or more polymers, may be the same or different than that of the remainder of the cover body. For instance, examples of the projections 110 may comprise a deformable material or a material otherwise softer than that of the body of the cover, thereby enhancing the cushioning effect of the kneepad as a whole.

Additional examples of the projections 110 may feature rigid or semi-rigid material compositions.

The number and size of the projections 110 may vary. Embodiments may lack any projections, or may include one or more projections, including two, three, four, five, six, seven, eight projections, or more. The dimensions and arrangement of the projections 110 may also vary such that the projections 110 may extend diagonally or vertically along the outer surface of the cover 102, for example. When two or more projections 110 are included, they may be approximately parallel to each other, or they may converge at various angles.

Embodiments of the shin section 108 may also feature one or more portions that protrude away from the outer surface of the cover 102. In some examples, elevation of the shin section 108 may position it on an approximately level plane with respect to the most elevated portion of the knee section 106 such that, when a user is kneeling, the shin section 108 and knee section 106 may contact the ground simultaneously, thereby increasing the contact surface area between the user and the ground and further reducing the localized pressure applied to the user's knee, including the pressure applied directly to the patella.

As further shown in FIGS. 1A and 1B, the cover 102 may define one or more additional raised areas or projections, such as knee projection 112 and shin projection 114. These projections provide an additional layer of structural support, protecting at least a portion of the patella and shin of a user, respectively.

The cover 102 may be made of a rigid or substantially rigid material, such as one or more plastics. Embodiments may additionally or alternatively feature a rubber or other resiliently deformable material, which may allow at least some deformation of the cover 102 under the weight of a user when kneeling. Such deformation may allow the cover 102 to form at least partially around the user's knee, thereby further distributing the pressure around the knee and enhancing the overall comfort of the device. Specific embodiments of the cover 102 may feature one or more polymers or polymer compositions, non-limiting examples of which may include ethylene-vinyl acetate. The cover 102 may comprise a unitary mold in some examples. Alternatively, the cover 102 may comprise a combination of molded and/or non-molded components attached or fixed together.

The inner cushion 104 may be inserted at least partially into a cavity defined by an inner, posterior surface of the cover 102 until a portion of the outer, anterior surface of the cushion 104 rests against or abuts an inner surface of the cover 102. In some examples, the cushion 104 may be pushed, urged, or otherwise positioned in the cavity defined by the cover 102 until at least a portion of the peripheral side edge of the cover 102 rests on or abuts a peripheral binding edge 116 of the cushion 104. A lower portion of the cover 102 may be inserted into or rest on a complementary recessed portion or channel 118 defined by a lower portion of the cushion 104. Non-limiting examples of the channel 118 may comprise a molded ethylene-vinyl acetate.

The inner cushion 104 may comprise a pad made from a variety of materials, non-limiting examples of which may include one or more gels, one or more plastics, one or more soft or semi-rigid foams, Styrofoam, or a combination thereof. Embodiments of the cushion 104 may feature two or more distinct layers of material. For example, the cushion 104 may include a non-flowable resilient gel sandwiched between a semi-rigid foam and a covering. Examples of the cushion 104 may include an outer anterior surface, opposite the knee, made of a semi-rigid material.

Figure 1C:
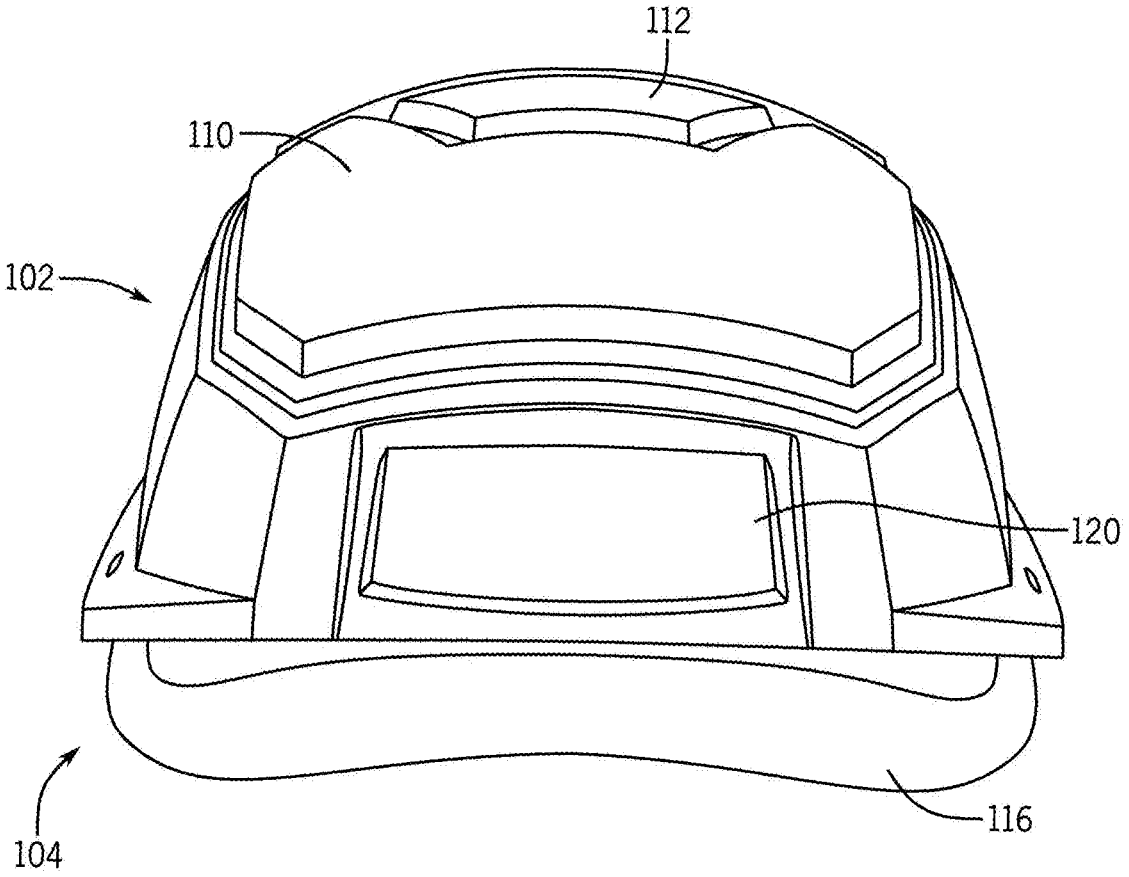
FIG. 1C illustrates a top view of the kneepad shown in FIG. 1B in accordance with embodiments of the present disclosure.

FIG. 1C provides a top view of the kneepad 100, showing an upper portion of the cover 102 and the cushion 104 coupled therewith. As shown, the cover 102 may define an aperture or opening 120, which may be configured to couple with an additional kneepad component, such as the upper extension shown in FIG. 2, by receiving one or more straps or other connection mechanisms in some examples. Coupling the cover 102 and the cushion 104 may involve positioning the top or upper edge of the cover 102 as close as possible to the top or upper edge of the cushion 104, for example near a binding edge 116 of the cushion 104 defining the cushion's peripheral edge.

Figure 1D:
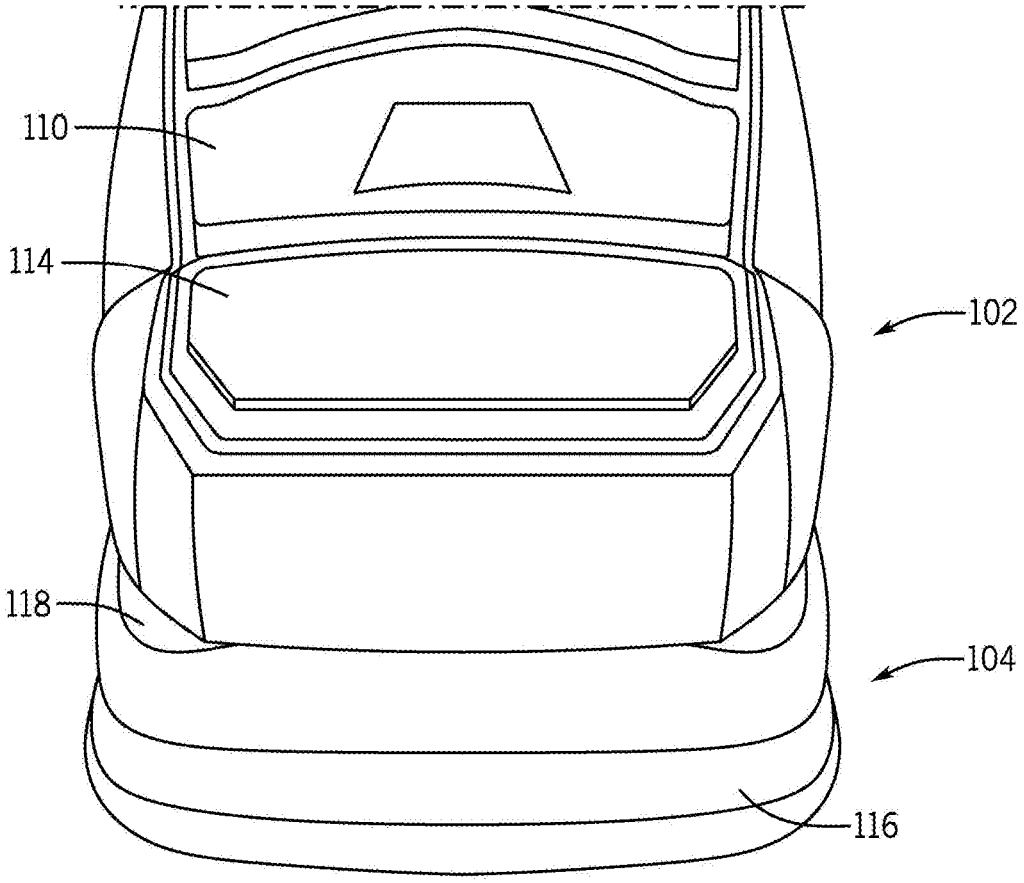
FIG. 1D illustrates a bottom view of the front of the kneepad shown in FIG. 1B in accordance with embodiments of the present disclosure.

FIG. 1D provides a bottom view of the front of the kneepad 100, showing a bottom or lower portion of the cover 102 and cushion 104. As noted above, the bottom or lower edge of the cover 102 may rest on or mate with the channel 118 defined by the cushion 104.

Figure 1E:
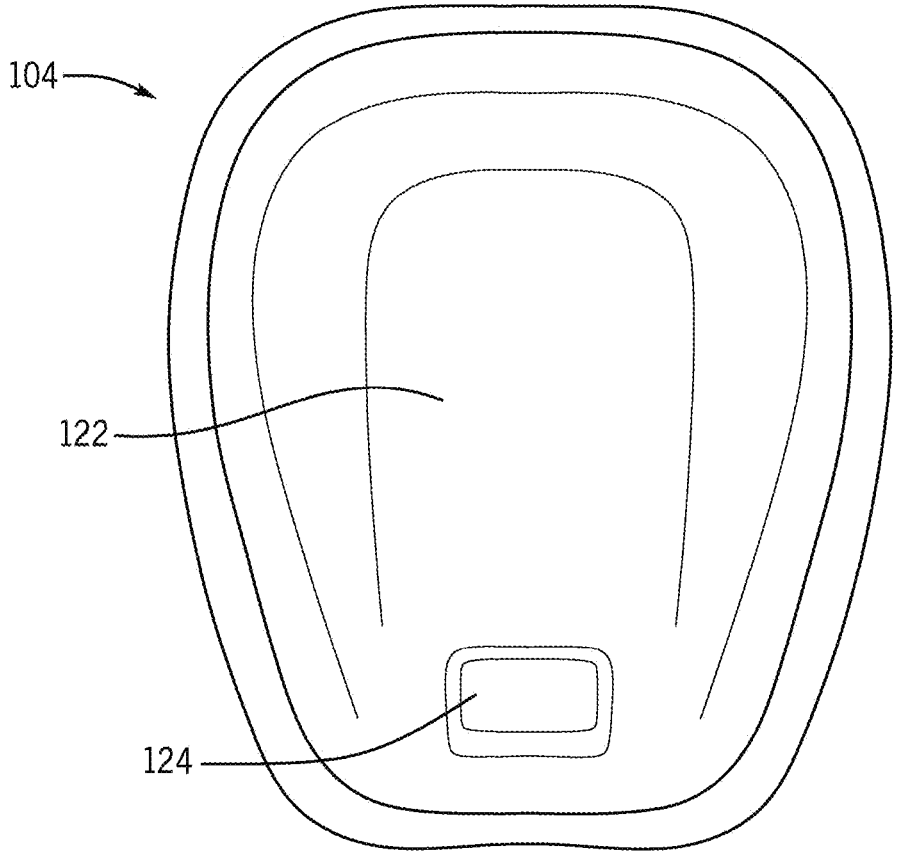
FIG. 1E illustrates a rear view of the cushion shown in FIG. 1B in accordance with embodiments of the present disclosure.

FIG. 1E provides a back or rear view of the cushion 104, showing its posterior, inner surface configured to contact the knee of a user. As shown, the cushion 104 may define a recessed portion or indentation 122, which may be sized and shaped to accommodate or receive at least the patella of a user's knee. The cushion 104 may also define a raised portion 124 that extends away from the inner surface of the cushion 104. The raised portion 124 may be configured to contact the shin of a user, and may be positioned directly behind the shin projection 114 protruding in the opposite direction, away from an outer surface of the front of the cover 102.

Figure 1F:
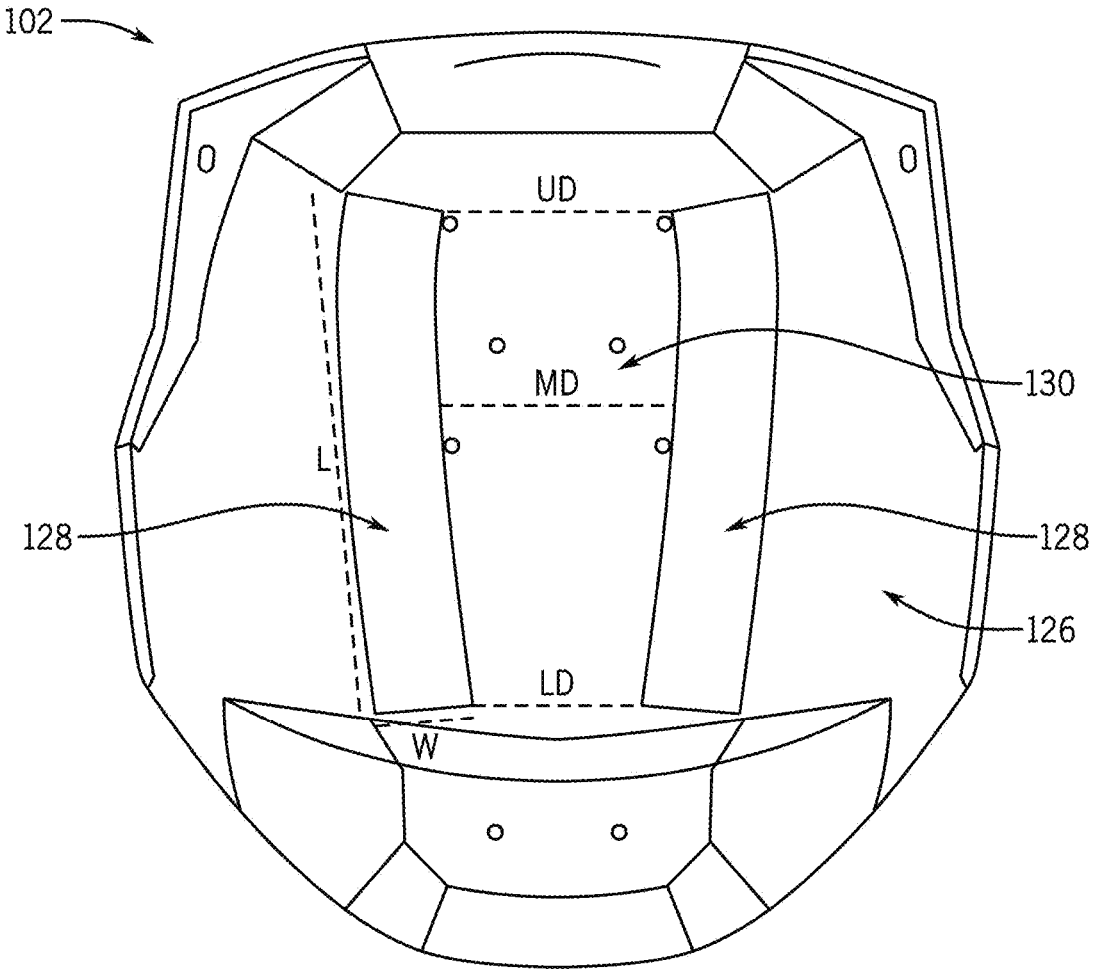
FIG. 1F illustrates a rear view of the cover shown in FIG. 1B in accordance with embodiments of the present disclosure.

FIG. 1F provides a back or rear view of the cover 102, showing its posterior, inner surface, where the cover 102 defines a cavity 126 configured to receive at least a portion of the cushion 104. The concave curvature of the cover 102 may be deeper than preexisting covers, creating a correspondingly deeper cavity 126. Due to this configuration of the cover 102, at least a portion of the inner surface of the cover 102 may not abut the outer surface of the cushion 104 when the two components are coupled. For example, the cover 102 may have a shape or curvature that does not match the shape or curvature of the cushion 104, even when the cushion 104 deforms under the weight of a user's knee, such that a gap remains between the inner surface of the cover 102 and the outer, anterior surface of the cushion 104. According to such embodiments, the cover 102 may define or be integrally formed with, attached to, or coupled with one or more protrusions, support members, or raised portions, e.g., strip-like components, that extend away from the inner surface of the cover 102, toward the cushion 104. The cover 102 shown in FIG. 1F, for example, includes two support members in the form of elongate strips 128 of material attached to its inner surface. The strips 128 may protrude away from the inner surface of the cover 102 and, in some examples, extend vertically between an upper portion and a lower portion of the cover 102. The strips 128 may be spaced apart and may rest against the outer surface of the cushion 104 upon coupling the cover 102 with the cushion 104, thereby defining an open space, gap, or air pocket 130 between the strips 128, the inner surface of the cover 102 and the outer surface of the cushion 104. The air pocket 130 defined by the cover 102, cushion 104, and strips 128 may advantageously reduce the pressure exerted on the knee of a user when kneeling or otherwise contacting a surface. A portion of the cushion 104 may extend or sag at least partially into the air pocket 130 when pressure is exerted against the cushion 104, forming a hammock-like structure between the strips 128. This novel pressure reduction mechanism created by the strips 128 and associated air pocket 130 may reduce the localized pressure exerted on a user's knee to a greater extent than preexisting kneepads. In some embodiments, inclusion of the strips 128 may also render the cover 102 compatible with more than one inner cushion, for example such that the same cover may be coupled with a variety of cushions having different sizes or curvatures.

The dimensions of the support members, protrusions, or strips 128 and their proximity to each other may vary. In some examples, the width w of each strip may range from about 5 mm to about 50 mm, about 10 mm to about 40 mm, about 15 mm to about 30 mm, about 20 mm to about 25 mm, or any width therebetween, such as about 8 mm, 10 mm, 12, mm, 14 mm, 16 mm, 18 mm, 20 mm, 22 mm, 24 mm, 26 mm, 28 mm, 30 mm, 32 mm, 34 mm, 36 mm, or more.

The length L of each support member, protrusion, or strip 128 may also vary, ranging in certain embodiments from about 2 cm to about 15 cm (equivalent to about 20 mm and about 150 mm, respectively), about 4 cm to about 14 cm, about 6 cm to about 13 cm, about 8 cm to about 12 cm, about 9 cm to about 11 cm, or any length therebetween, including about 10 cm.

The distance between the support members, protrusions, or strips 128 may vary at different points along the length of the strips 128, for example in embodiments featuring curved strips. Embodiments may feature more than two strips 128, including three, four, five, six, or more strips. Different configurations and arrangements of the strips may be implemented. For example, the strips 128 shown in FIG. 1F each have a slight curvature, such that the upper ends of the strips curve toward each other, as do the lower ends. Between the upper and lower ends, the strips 128 may curve away from each other, such that the maximum distance between the strips 128 may be defined near the longitudinal middle portion of the strips. This curvature may approximately match the outer contours of the patella.

In embodiments, the distance UD between the upper ends of the strips may range from about 30 mm to about 70 mm, about 35 mm to about 65 mm, about 40 mm to about 60 mm, about 45 mm to about 55 mm, about 48 mm to about 52 mm, or any distance therebetween, including about 49 mm, about 50 mm, about 51 mm, about 52 mm, or more. The distance MD between a middle portion of the strips, where the distance may reach its maximum, may range from about 40 mm to about 76 mm, about 46 mm to about 70 mm, about 52 mm to about 64 mm, about 54 mm to about 62 mm, about 56 mm to about 60 mm, about 57 to about 59 mm, or any distance therebetween, including about 58 mm. The distance LD between the lower ends of the strips may range from about 30 mm to about 70 mm, about 35 mm to about 65 mm, about 40 mm to about 60 mm, about 45 mm to about 55 mm, about 48 mm to about 52 mm, or any distance therebetween, including about 49 mm, about 50 mm, about 51 mm, or about 52 mm.

The height or cross-sectional thickness of the support members, protrusions, or strips (measured into or out of the page in FIG. 1F, away from the inner surface of the cover 102, shown also in FIG. 1H) may also vary, and may depend on whether the strips are formed integrally with, e.g., molded with, the curved body of the cover. Embodiments may include support members, protrusions, or strips having a height ranging from about 1 mm to about 20 mm, about 2 mm to about 19 mm, about 3 mm to about 18 mm, about 4 mm to about 17 mm, about 5 mm to about 16 mm, about 6 mm to about 15 mm, about 7 mm to about 14 mm, about 8 mm to about 13 mm, about 9 mm to about 12 mm, about 9.5 mm to about 11 mm, about 9.8 mm to about 10.2 mm, about 9.9 mm to about 10.1 mm, or any height therebetween, including for instance about 4 mm, about 5 mm, about 6 mm, about 7 mm, about 8 mm, about 9 mm, about 10 mm, about 11 mm, about 12 mm, about 13 mm, about 14 mm, about 15 mm, or more, or any height therebetween.

The height of each strip may be greater in examples featuring strips having a different material composition than that of the curved body of the cover. For instance, embodiments of the strips made of a foam material or molded foam composition may have a height ranging from about 5 mm to about 15 mm, e.g., about 10 mm, when at least a portion of the curved body of the cover comprises or features a different material composition, e.g., a molded plastic composition. In some examples, the total height of the strips may be defined by protrusions molded within the cover and a distinct material composition layered on top of, or attached to, the protrusions. The distinct material composition may comprise a foam material or modified molded foam, and/or one or more polymers in various embodiments.

Embodiments of the strips molded integrally with the curved body of the cover, and having the same or similar material composition as the curved body of the cover, may have a height ranging from about 2 mm to about 10 mm, about 3 mm to about 6 mm, about 4 mm to about 5 mm, or any height therebetween, including about 3 mm, about 4 mm, about 5 mm, about 6 mm, about 7 mm, about 8 mm, or about 9 mm. In some examples, the strips may comprise a combination of a modified mold formed with the curved body of the cover, and added molded foam, the latter of which may have a height of about 4 mm, about 5 mm, about 6 mm, about 7 mm, about 8 mm, about 9 mm, about 10 mm, or more, or any height therebetween. Together, the modified mold formed with the curved body of the cover and the added molded foam may have a height of about 5 mm to about 15 mm, e.g., about 10 mm.

A non-limiting example may feature strips 128 each having a width w of about 20 mm and a length L of about 10 cm. The distance between the strips may range from about 48 mm to about 60 mm along the length of the strips, for instance such that the distance UD between the upper ends of the strips may be about 52 mm, the maximum distance MD between a middle portion of the strips may be about 58 mm, and the distance LD between the lower ends of the strips may be about 50 mm. One or more of the strips, e.g., each of two strips, may have a height H of about 10 mm.

In some embodiments, the strips 128 may be parallel or substantially parallel along at least a portion of their length. Embodiments may feature parallel or substantially parallel strips that extend horizontally between the left and right sides of the cover 102. Embodiments may also feature two or more overlapping strips, or strips that are perpendicular or substantially perpendicular. The strips may also define a shape, such as a rectangle or square defined by four strips, or a circle or oval defined by one or more strips.

The strips 128 may be made of a variety of materials, non-limiting examples of which may include one or more foams or foam-like materials. The strips 128 may be removable in some embodiments, such that the strips comprise detachable inserts. In other embodiments, the strips 128 may be formed integrally with the cover 102. The cover may comprise a unitary mold in such examples, with the strips comprising ridges or protrusions that extend toward a user's knee.

Embodiments may include a variety of different support members positioned between the inner surface of the cover 102 and the outer surface of the cushion 104 configured to create one or more air pockets between the cover and cushion. In lieu of or in addition to raised strips of material, for example, embodiments may include raised areas or protrusions of various shapes and sizes. For instance, embodiments may additionally or alternatively include one or more nodules or peg-like features attached to or formed integrally with the cover 102. The nodules may be less elongate than the strips shown in FIG. 1F, resembling cylindrical protrusions in some examples that have a circular or oval-shaped cross section. The nodules or other protrusions may have a flat or curved outer surface configured to contact the outer surface of the cushion. The number of protrusions or nodules may vary, ranging from only one nodule to at least two nodules, three nodules, four nodules, five nodules, six nodules, or more. One or more air pocket(s) may be defined by the space between the nodules, together with the inner surface of the cover and outer surface of the cushion 104. In some examples, one or more strips may be interspersed with one or more nodules. Generally, the number of air pockets may be defined by the number of raised surfaces or protrusions. In the embodiment shown in FIG. 1F, two strips 128 define an air pocket 130 therebetween. Addition of a third strip may result in the formation of a second air pocket. The shape of the cover 102 and/or cushion 104 may also impact the size and number of air pockets formed between the two components.

Figure 1G:
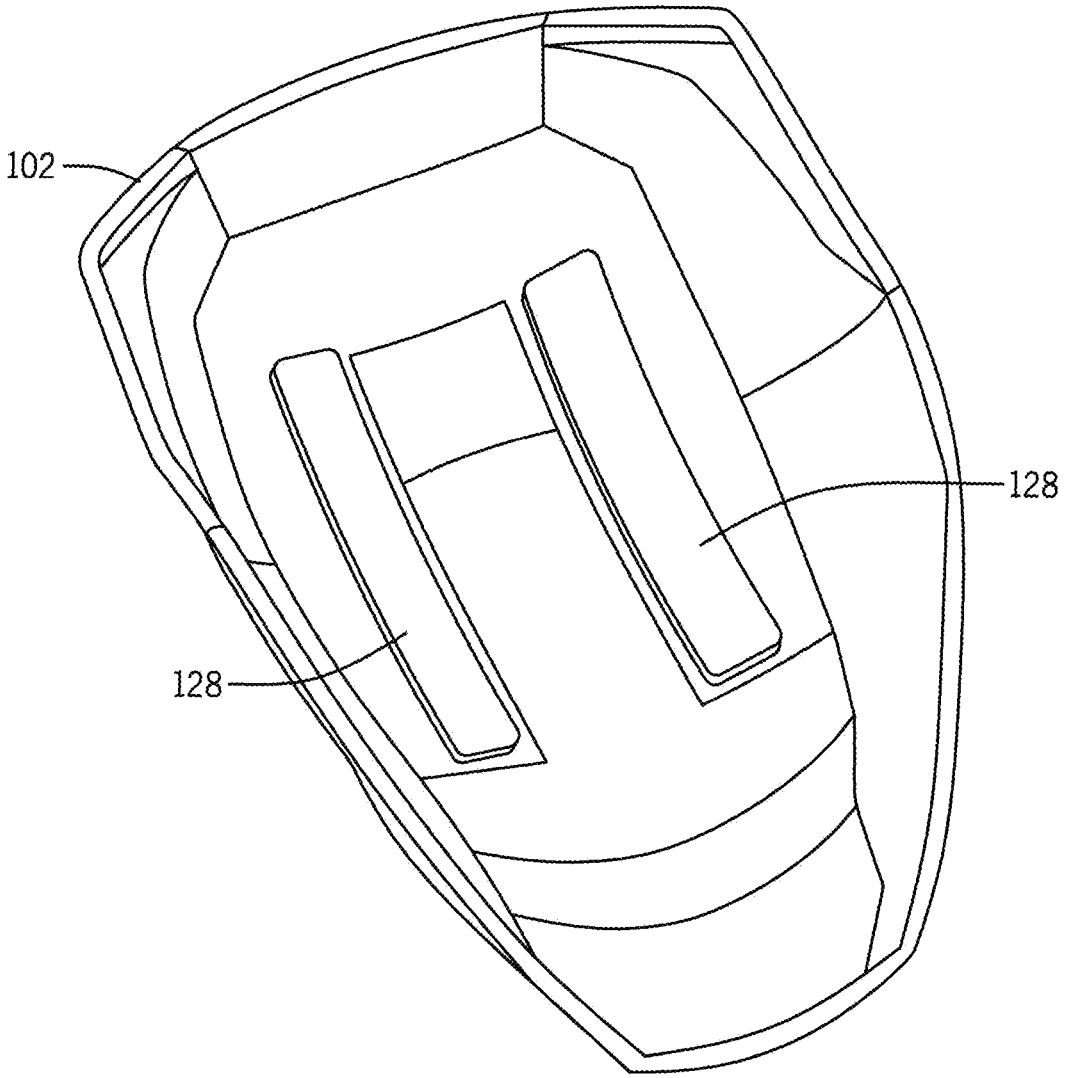
FIG. 1G illustrates a rear perspective view of the cover shown in FIG. 1F in accordance with embodiments of the present disclosure.

FIG. 1G provides a perspective view of the inner surface of the cover 102, showing two strips 128 attached to or formed with the cover 102. In some examples, the material composition of the strips 128 may be distinct from that of the cover 102. The material composition may also extend beyond the discernible boundaries of the strips 128, which may include or be defined by the peripheral contact points of the strips against the inner surface of the cover 102, thereby expanding the footprint of the strips 128 (or other protrusions) against the inner surface of the cover. By enlarging the interface between the strips 128 and the inner surface of the cover 102, the connection strength between the two components may be increased.

Figure 1H:
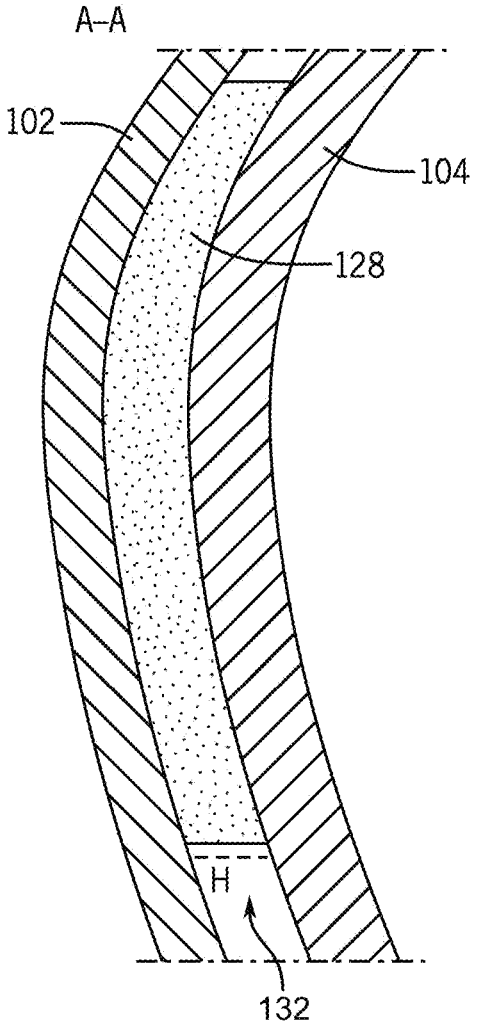
FIG. 1H illustrates a schematic cross-sectional side view of a portion of the kneepad shown in FIG. 1A, taken along line A-A, in accordance with embodiments of the present disclosure.

FIG. 1H provides a schematic cross-sectional side view of a portion of the kneepad 100, taken along line A-A of FIG. 1A, showing cross-sectional slices of a portion of the cover 102 and cushion 104, as well as a strip 128 sandwiched therebetween. As shown, the strip 128 may span the gap 132 between the cover 102 and cushion 104 that remains after coupling the two components. The gap 132 may be present and/or enlarged in embodiments of the kneepad 100 featuring a cover 102 that defines an especially deep inner cavity, which may be defined as a cavity that is deeper than that defined by the cushion 104. In combination, the strip 128 shown in FIG. 1H and a second, laterally adjacent strip may define an air pocket 130 between the cover 102 and the cushion 104 configured to reduce the pressure localized at one or more portions of a user's knee, including the patella. The strip may have a cross-sectional thickness or height H ranging from about 1 mm to about 20 mm, as noted above. The strip 128 may be compressed upon coupling the cushion 104 with the cover 102. The level of compression may increase when a user wearing the kneepad 100 kneels or otherwise contacts an exterior surface, such as the ground.

Figure 2:
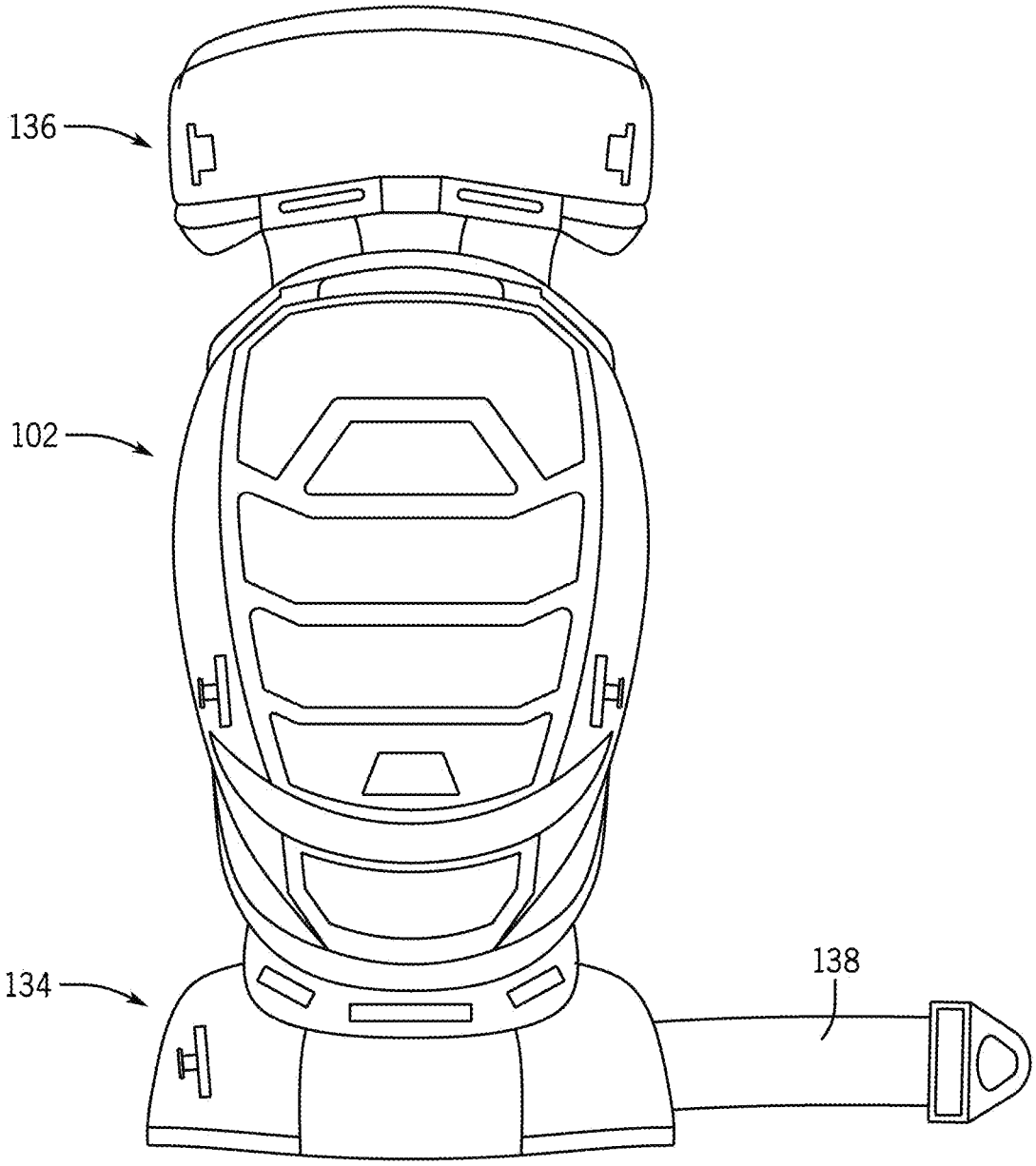
FIG. 2 illustrates a front view of the kneepad shown in FIG. 1B, including an upper extension and a lower extension coupled with the kneepad in accordance with embodiments of the present disclosure.

FIG. 2 is a front view of the kneepad 100 coupled with a lower attachment member or extension 134 and an upper attachment member or extension 136. The lower extension 134 is coupled with or attached to a strap 138 configured to wrap around the user's lower leg and secure the kneepad 100 to the user's knee. The upper extension 136 is configured to cover a portion of the user's leg at least partially above the knee, for example a lower portion of the thigh. Both the lower extension 134 and upper extension 136 may be configured to move relative to the cover 102 of the kneepad 100 while remaining attached thereto. For example, the extensions 134, 136 may be configured to move relative to the cover 102 in a hinge-like fashion such that the extensions resemble movable flaps. As a result, the cover 102 remains properly positioned over the knee, the lower extension 134 remains positioned over the shin, and the upper extension 136 remains positioned over the thigh while the kneepad is being worn, as the user kneels, walks, and otherwise changes positions.

The front surface of the upper extension 136 may be textured, which may reduce slippage of the extension 136 and kneepad as a whole. The material composition of the upper extension 136 may include one or more plastics or polymer compositions, which may be rigid or semi-rigid to maximize strength and durability. According to such embodiments, the upper extension 136 may provide an outer shell similar to that provided by the cover 102. Kneepads featuring the upper extension 136 may therefore be considered dual-shell kneepads that provide two protective covers or shells configured to separately cover at least a portion of a user's knee and thigh. In some examples, the upper extension 136 may comprise a surface layer or plate that is harder and/or more rigid than the remainder of the extension 136 positioned behind the outer surface, which may be considered the body portion of the extension. The hardness values of the outer surface or plate relative to the underlying material of the body portion of the upper extension 136 may therefore be similar to that of the cover 102 and cushion 104, such that the extension 136 is a durable structure with a resiliency sufficient to contact hard surfaces without being damaged, as well as a softness sufficient to form around and comfortably reduce pressure on a user's thigh.

One or more components of the cover 102 may be formed via a molding process, which may further involve attaching or affixing two or more molded or non-molded components together. In some examples, the curved body of the cover may be molded separately from the inner support members, protrusions, or strips, which may comprise one or more pre-formed molds, foams, or molded foam compositions.

Although the present disclosure provides references to various embodiments, persons skilled in the art will recognize that changes may be made in form and detail without departing from the spirit and scope of the invention. The Detailed Description should be read with reference to the drawings. The drawings show, by way of illustration, specific embodiments of the present kneepad structures and components. These embodiments are also referred to herein as "examples," which should not be construed as limiting.

Certain terms are used throughout this patent document to refer to particular features or components. As one skilled in the art will appreciate, different people may refer to the same feature or component by different names. This patent document does not intend to distinguish between components or features that differ in name but not in function. For the following defined terms, certain definitions shall be applied unless a different definition is given elsewhere in this patent document. The terms "a," "an," and "the" are used to include one or more than one, independent of any other instances or usages of "at least one" or "one or more." The term "or" is used to refer to a nonexclusive or, such that "A or B" includes "A but not B," "B but not A," and "A and B." All numeric values are assumed to be modified by the term "about," whether or not explicitly indicated. The term "about" refers to a range of numbers that one of skill in the art considers equivalent to the recited value (i.e., having the same function or result). In many instances, the term "about" can include numbers that are rounded to the nearest significant figure. The recitation of numerical ranges by endpoints includes all numbers and sub-ranges within and bounding that range (e.g., 1 to 4 includes 1, 1.5, 1.75, 2, 2.3, 2.6, 2.9, etc. and 1 to 1.5, 1 to 2, 1 to 3, 2 to 3.5, 2 to 4, 3 to 4, etc.).

What is claimed is:

1. A kneepad comprising:

an outer cover having a curved body and comprising two or more protrusions positioned along an inner surface of the curved body; and an inner cushion configured to couple with the outer cover and contact a knee of a user when worn by the user, the outer cover having a hardness that is greater than that of the cushion, wherein when coupled, the outer cover and inner cushion define an air pocket therebetween, the air pocket is further defined between the two or more protrusions, and the two or more protrusions comprise two elongate curved protrusions configured to curve around a patella of the knee, such that when the kneepad is worn, a portion of the inner cushion positioned over the patella sags into the air pocket defined between the two elongate curved protrusions.

2. The kneepad of claim 1, wherein the protrusions extend away from the inner surface of the curved body of the cover, toward the inner cushion.

3. The kneepad of claim 1, wherein the two elongate curved protrusions have a material composition distinct from that of the curved body.

4. The kneepad of claim 3, wherein the two elongate curved protrusions comprise one or more foam compositions.

5. The kneepad of claim 1, wherein two elongate curved protrusions are comprised of one or more gels, one or more plastics, one or more foams, styrofoam, or a combination thereof.

6. The kneepad of claim 2, wherein the protrusions are defined by the curved body.

7. The kneepad of claim 6, wherein the outer cover comprises a unitary mold.

8. The kneepad of claim 1, wherein the air pocket reduces a pressure exerted on the knee when the user kneels while wearing the kneepad.

9. The kneepad of claim 1, wherein a distance between the elongate curved protrusions varies along a length of the protrusions.

10. The kneepad of claim 1, wherein each of the two or more protrusions has a length of 8 cm to about 12 cm, and a width of 15 mm to about 30 mm.

11. The kneepad of claim 1, wherein the curved body further comprises at least one raised portion protruding from an outer surface of the curved body, the raised portion configured to be positioned over at least a portion of a shin of the user when the kneepad is worn.

12. The kneepad of claim 1, further comprising an upper extension configured to be positioned at least partially above a patella and over a thigh of the user when the kneepad is worn.

13. The kneepad of claim 12, wherein the upper extension comprises a textured outer surface.

14. The kneepad of claim 13, wherein the textured surface comprises a plurality of grooves and ridges.

15. The kneepad of claim 12, wherein the upper extension is configured to move or pivot relative to the curved body.

16. The kneepad of claim 12, wherein the upper extension comprises a body portion and an outer surface layer, the outer surface layer having a hardness that is greater than that of the body portion.

17. The kneepad of claim 16, wherein the outer surface layer comprises a plate.

18. A kneepad cover comprising:

a curved body, an inner cushion, and two or more spaced apart and elongate protrusions positioned along an inner surface of the curved body and defining an air pocket between the curved body and inner cushion, wherein the curved body comprises a polymer composition configured to resist damage when engaging hard surfaces, wherein the curved body corresponds to a curvature of a knee of a user, wherein the two or more spaced apart and elongate protrusions are configured to extend about a patella of the knee.

19. The kneepad cover of claim 18, wherein the two or more spaced apart and elongate protrusions comprise two raised strips of material that protrude away from the inner surface of the curved body, such that upon placing the kneepad cover over the knee of the user, the two or more raised strips of material protrude toward the knee.

20. The kneepad cover of claim 19, wherein a distance between the two or more raised strips of material varies along a length of the strips, ranging from 40 mm to 70 mm.

21. The kneepad cover of claim 19, wherein the two or more raised strips of material are curved.

22. The kneepad cover of claim 18, wherein a material of the two or more spaced apart and elongate protrusions is identical to that of the curved body.

23. The kneepad cover of claim 18, wherein the kneepad cover is a unitary mold.

24. The kneepad cover of claim 18, wherein a material of the two or more spaced apart and elongate protrusions is distinct from that of the curved body.

25. The kneepad cover of claim 24, wherein the two or more spaced apart and elongate protrusions are attached to the inner surface of the curved body.

26. The kneepad cover of claim 25, wherein the two or more spaced apart and elongate protrusions comprise detachable inserts.

27. A kneepad comprising:

an outer cover having a curved body and comprising two or more protrusions positioned along an inner surface of the curved body, wherein the two or more protrusions comprise two or more raised strips of material comprised of one or more foam compositions; and an inner cushion configured to couple with the outer cover and contact a knee of a user when worn by the user, the outer cover having a hardness that is greater than that of the cushion, wherein when coupled, the outer cover and inner cushion define an air pocket therebetween.

28. The kneepad of claim 27, wherein the two or more raised strips of material are curved.

29. The kneepad of claim 27, wherein the two or more protrusions are spaced apart and define an air pocket between the curved body and inner cushion.

* * * * *